United States Patent [19]

Grawi

[11] Patent Number: 4,646,876

[45] Date of Patent: Mar. 3, 1987

[54] WALKING LADDER

[76] Inventor: Robert S. Grawi, 655-6th Ave., Rm. 215, New York, N.Y. 10010

[21] Appl. No.: 860,907

[22] Filed: May 8, 1986

[51] Int. Cl.[4] ..... E06C 5/00

[52] U.S. Cl. ..... 182/15; 182/167

[58] Field of Search ..... 182/15, 13, 12, 17, 182/104, 129, 165, 194, 166, 167

[56] References Cited

U.S. PATENT DOCUMENTS

| | | | |
|---|---|---|---|
| 1,467,245 | 9/1923 | Anlauf | 182/104 |
| 1,510,461 | 10/1924 | Cordes | 182/13 |
| 1,701,951 | 2/1929 | Holt | 182/15 |
| 2,630,961 | 3/1953 | Burg | 182/15 |
| 2,707,585 | 5/1955 | Hoey | 182/17 |
| 2,775,488 | 12/1956 | Wingrove | 182/13 |
| 2,845,208 | 7/1958 | Antonietti | 182/13 |
| 2,980,200 | 4/1961 | Kibby | 182/17 |
| 3,447,632 | 6/1969 | Boyd | 182/116 |
| 3,857,460 | 12/1974 | Nini | 182/17 |

*Primary Examiner*—Reinaldo P. Machado
*Attorney, Agent, or Firm*—Richard L. Miller

[57] ABSTRACT

A walking ladder is provided and consists of a spring loaded tripod suspended from a step ladder which converts the step ladder into a self moving support. A person standing on the step ladder can shift their weight from the ladder to the tripod and then back onto the ladder while always remaining on the ladder so as to reposition the ladder anywhere in the immediate area of the tripod.

7 Claims, 6 Drawing Figures

WALKING LADDER

BACKGROUND OF THE INVENTION

The instant invention relates generally to ladders and more specifically it relates to a walking ladder.

Numerous ladders have been provided in prior art to support people and perform various other functions. While these units may be suitable for the particular purpose to which they address, they would not be as suitable for the purposes of the present invention as heretofore described.

SUMMARY OF THE INVENTION

A primary object of the present invention is to provide a walking ladder that will overcome the shortcomings of the prior art devices.

Another object is to provide a walking ladder that utilizes a spring loaded tripod suspended from a step ladder which converts the step ladder into the versatility of a self moving support.

An additional object is to provide a walking ladder in which a person standing on the step ladder can shift their weight from the ladder to the tripod and then back onto the ladder from the tripod while always remaining on the ladder so as to reposition the ladder anywhere in the immediate areas of the tripod.

A further object is to provide a walking ladder that is simple and easy to use.

A still further object is to provide a walking ladder that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
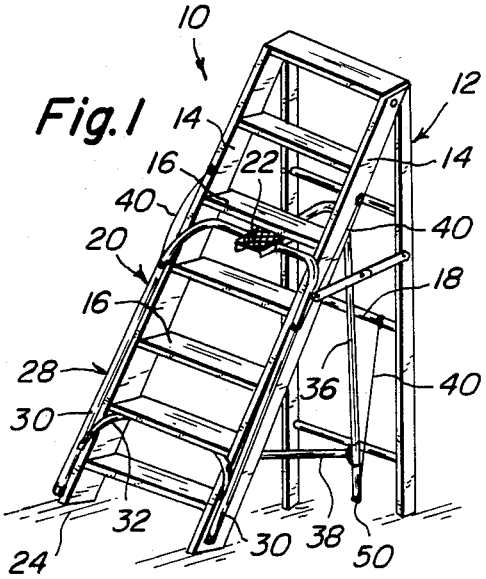
FIG. 1 is a perspective view of the invention installed on a ladder.

Turning now descriptively to the drawings, in which similar reference characters denote similar elements throughout the several views, FIGS. 1 through 6 illustrate a walking ladder 10 that consists of a step ladder 12 having a pair of side rails 14, a plurality of steps 16 and a cross brace 18 thereon. A tripod 20 that has a top platform 22 is movably suspended from the step ladder 12. The tripod is normally suspended above a floor 24 with the top platform 22 under and extending outwardly from one of the steps 16.

A user (not shown) of the walking ladder 10 can place one foot on the step 16 and the other foot on the top platform 22. When the user shifts weight onto the top platform the tripod 20 will travel down to rest on the floor 24 allowing the user to reposition the step ladder 10 anywhere in immediate area 26 (see FIG. 6) of the tripod 20. When the user shifts weight back onto the step 16 the tripod will travel up above the floor 24.

The tripod 20 is foldable and consists of an inverted U-shaped member 28 forming front legs 30 thereof. A stationary horizontal inwardly bent support member 32 extends between the front legs 30 so as to fit under one of the lower steps 16 of the step ladder 12. A lock joint 34 extends rearwardly from the top platform 22. A foldable rear leg 36 extends downwardly from the lock joint 34.

A foldable horizontal support member 38 extends between the rear leg 36 and middle of the stationary horizontal support member 32 so that the tripod 20 can fold with the step ladder 12 when storing the step ladder.

The elastic cords 40 are used to suspend the tripod 20 from the step ladder 12. Two of the cords 40 extend between the front legs 30 and the side rails 14 while the third cord 40 extends between the rear leg 36 of the tripod and the cross brace 18 of the step ladder.

Figure 2:
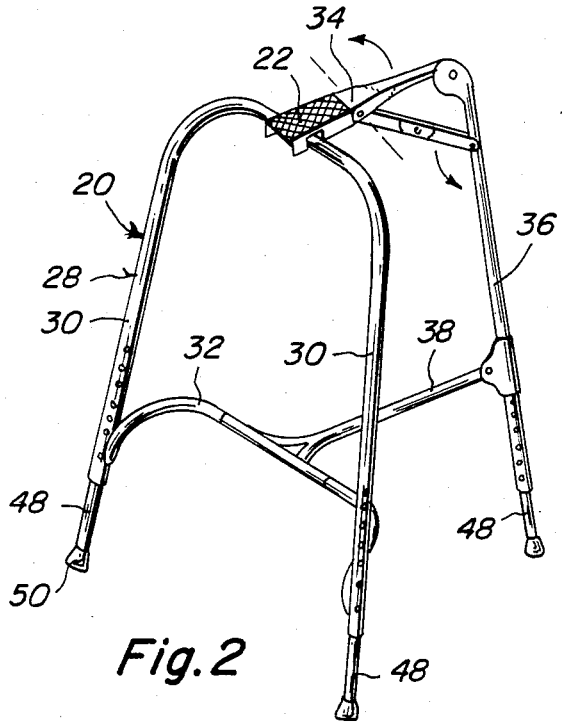
FIG. 2 is an enlarged perspective view of the instant invention per se.
Figure 3:
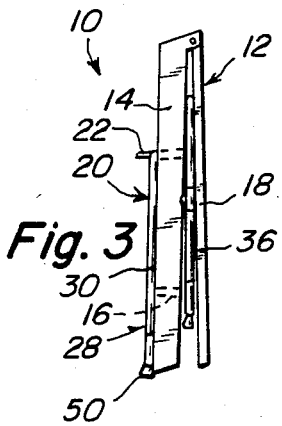
FIG. 3 is a side view of the invention and ladder in a folded position.
Figure 4:
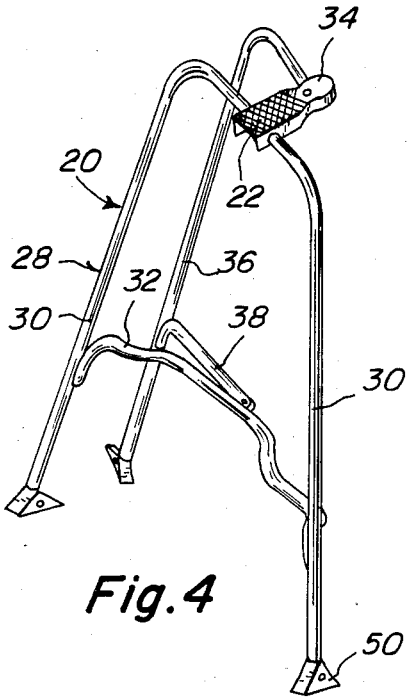
FIG. 4 is an enlarged perspective view of a modification thereof.

As best seen in FIG. 2 the lock joint 34, the foldable rear leg 36 and the foldable support member 38 of the tripod 20 all fold upwardly when placed in a stored position. As best seen in FIG. 4 the lock joint 34, the foldable rear leg 36 and the foldable support member 38 of the tripod 20 all fold sidewardly when placed in a stored position.

Figure 5:
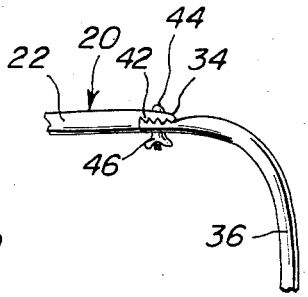
FIG. 5 is a partial side view of a modification of just the locking joint which may be incorporated in the instant invention.
Figure 6:
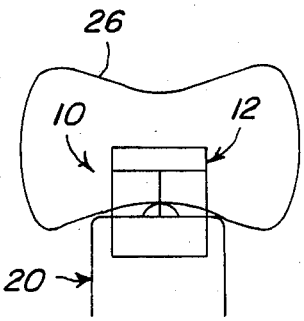
FIG. 6 is a diagrammatic plan view of the invention installed on a ladder illustrating the range of motion that the instant invention permits the user to move the ladder without climbing down to the floor.

FIG. 5 shows the lock joint 34 further containing radial teeth 42 and a threaded bolt 44 with nut 46 so as to lock the lock joint in a useable position and in a stored position.

The legs 30 and 36 of the tripod 20 can be height adjustable as indicated by mechanism 48 so as to fit various sized step ladders 12 (see FIG. 2). The legs are also fitted with non-skid tips 50.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A walking ladder comprising:

(a) a step ladder having a pair of side rails, a plurality of steps and a cross brace thereon;

(b) a tripod having a top platform; and (c) means for movably suspending said tripod from said step ladder in which said tripod is normally suspended above a floor with said top platform under and extending outwardly from one of said steps so that user of said walking ladder can place one foot on said step and other foot on said top platform, whereby when said user shifts weight onto said top platform said tripod will travel down to rest on said floor allowing said user to reposition said step ladder anywhere in immediate area of said tripod and when said user shifts weight back onto said step said tripod will travel up above said floor.

2. A walking ladder as recited in claim 1 wherein said tripod is foldable and comprises:

(a) an inverted U-shaped member forming front legs thereof;

(b) a stationary horizontal inwardly bent support member extending between said front legs so as to fit under one of said lower steps of said step ladder;

(c) a lock joint extending rearwardly from said top platform;

(d) a foldable rear leg extending downwardly from said lock joint; and (e) a foldable horizontal support member extending between said rear leg and middle of said stationary horizontal support member so that said tripod can fold with said step ladder when storing said step ladder.

3. A walking ladder as recited in claim 2 wherein said movably suspending means includes three elastic cords, two of said cords extend between said front legs of said tripod and said side rails while said third cord extends between said rear leg of said tripod and said cross brace of said step ladder.

4. A walking ladder as recited in claim 3 wherein said lock joint, said foldable rear leg and said foldable support member of said tripod all fold upwardly when placed in a stored position.

5. A walking ladder as recited in claim 3 wherein said lock joint, said foldable rear leg and said foldable support member of said tripod all fold sidewardly when placed in a stored position.

6. A walking ladder as recited in claim 5 wherein said lock joint further comprises radial teeth and a threaded bolt with a nut so as to lock said lock joint in a useable position and in a stored position.

7. A walking ladder as recited in claim 4 wherein said each of said legs of said tripod are height adjustable so as to fit various sized step ladders and are also fitted with non-skid tips.

* * * * *